US006321394B1

(12) United States Patent
Steir et al.

(10) Patent No.: US 6,321,394 B1
(45) Date of Patent: Nov. 27, 2001

(54) TOILET SEAT CLOSING SYSTEM

(76) Inventors: Junior Steir; Gladys M. Steir, both of 5391 Via Maior Apt. 371, Orlando, FL (US) 32808

( * ) Notice: Subject to any disclaimer, the term of this patent is extended or adjusted under 35 U.S.C. 154(b) by 0 days.

(21) Appl. No.: 09/648,133

(22) Filed: Aug. 25, 2000

(51) Int. Cl.[7] ..... A47K 13/10
(52) U.S. Cl. ..... 4/246.2; 4/246.1; 4/248
(58) Field of Search ..... 4/246.1, 246.2, 4/248

(56) References Cited

U.S. PATENT DOCUMENTS

| | | | | |
|---|---|---|---|---|
| D. 356,366 | | 3/1995 | Denapoli . | |
| 475,170 | * | 5/1892 | Webster | 4/248 |
| 2,088,050 | * | 7/1937 | Brown | 4/248 X |
| 2,814,049 | | 11/1957 | Mercur . | |
| 2,849,728 | * | 9/1958 | Gyllenberg | 4/246.2 |
| 4,491,989 | | 1/1985 | Mcgrail . | |
| 4,551,866 | | 11/1985 | Hibbs . | |
| 5,388,281 | | 2/1995 | Wiklund et al. . | |
| 5,504,947 | * | 4/1996 | Robello et al. | 4/246.1 |
| 5,604,936 | * | 2/1997 | Mausolf | 4/246.1 |
| 5,742,949 | * | 4/1998 | Goldi et al. | 4/246.2 |
| 5,794,277 | | 8/1998 | Jones . | |

FOREIGN PATENT DOCUMENTS

| | | | | |
|---|---|---|---|---|
| 6113981 | * | 4/1994 | (JP) | 4/248 |

* cited by examiner

*Primary Examiner*—Robert M. Fetsuga

(57) ABSTRACT

A toilet seat closing system for automatically lowering a seat over the bowl portion of a toilet after use. The toilet seat closing system includes a toilet with a bowl portion, a seat assembly pivotally coupled to the bowl assembly, and a seat lowering assembly coupled to the bowl assembly and coupled to the seat assembly by a pair of pistons.

7 Claims, 4 Drawing Sheets

TOILET SEAT CLOSING SYSTEM

BACKGROUND OF THE INVENTION

1. Field of the Invention

The present invention relates to automatic closing devices and more particularly pertains to a new toilet seat closing system for automatically lowering a seat over the bowl portion of a toilet after use.

2. Description of the Prior Art

The use of automatic closing devices is known in the prior art. More specifically, automatic closing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,388,281; 2,814,049; 4,493,989; 5,794,277; 4,551,866; and Des. 356,366.

While these devices fulfill their respective, particular objectives and requirements, the aforementioned patents do not disclose a new toilet seat closing system. The inventive device includes a toilet with a bowl portion, a seat assembly pivotally coupled to the bowl assembly, and a seat lowering assembly coupled to the bowl assembly and coupled to the seat assembly by a pair of pistons.

In these respects, the toilet seat closing system according to the present invention substantially departs from the conventional concepts and designs of the prior art, and in so doing provides an apparatus primarily developed for the purpose of automatically lowering a seat over the bowl portion of a toilet after use.

SUMMARY OF THE INVENTION

In view of the foregoing disadvantages inherent in the known types of automatic closing devices now present in the prior art, the present invention provides a new toilet seat closing system construction wherein the same can be utilized for automatically lowering a seat over the bowl portion of a toilet after use.

The general purpose of the present invention, which will be described subsequently in greater detail, is to provide a new toilet seat closing system apparatus and method which has many of the advantages of the automatic closing devices mentioned heretofore and many novel features that result in a new toilet seat closing system which is not anticipated, rendered obvious, suggested, or even implied by any of the prior art automatic closing devices, either alone or in any combination thereof.

To attain this, the present invention generally comprises a toilet with a bowl portion, a seat assembly pivotally coupled to the bowl assembly, and a seat lowering assembly coupled to the bowl assembly and coupled to the seat assembly by a pair of pistons.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet seat closing system apparatus and method which has many of the advantages of the automatic closing devices mentioned heretofore and many novel features that result in a new toilet seat closing system which is not anticipated, rendered obvious, suggested, or even implied by any of the prior art automatic closing devices, either alone or in any combination thereof.

It is another object of the present invention to provide a new toilet seat closing system which may be easily and efficiently manufactured and marketed.

It is a further object of the present invention to provide a new toilet seat closing system which is of a durable and reliable construction.

An even further object of the present invention is to provide a new toilet seat closing system which is susceptible of a low cost of manufacture with regard to both materials and labor, and which accordingly is then susceptible of low prices of sale to the consuming public, thereby making such toilet seat closing system economically available to the buying public.

Still yet another object of the present invention is to provide a new toilet seat closing system which provides in the apparatuses and methods of the prior art some of the advantages thereof, while simultaneously overcoming some of the disadvantages normally associated therewith.

Still another object of the present invention is to provide a new toilet seat closing system for automatically lowering a seat over the bowl portion of a toilet after use.

Yet another object of the present invention is to provide a new toilet seat closing system which includes a toilet with a bowl portion, a seat assembly pivotally coupled to the bowl assembly, and a seat lowering assembly coupled to the bowl assembly and coupled to the seat assembly by a pair of pistons.

Still yet another object of the present invention is to provide a new toilet seat closing system that promotes domestic tranquility.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
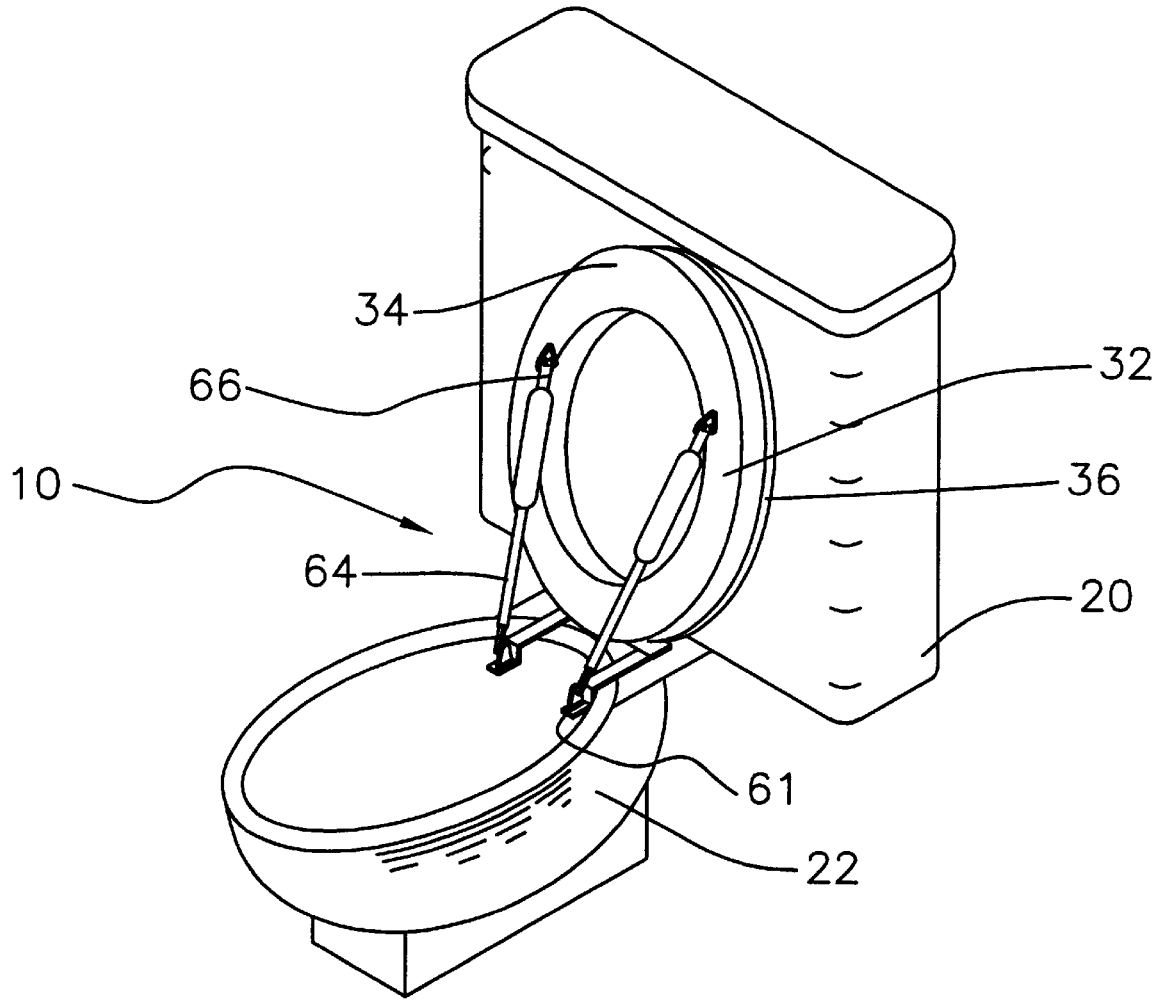
FIG. 1 is a schematic perspective view of a new toilet seat closing system according to the present invention.
Figure 2:
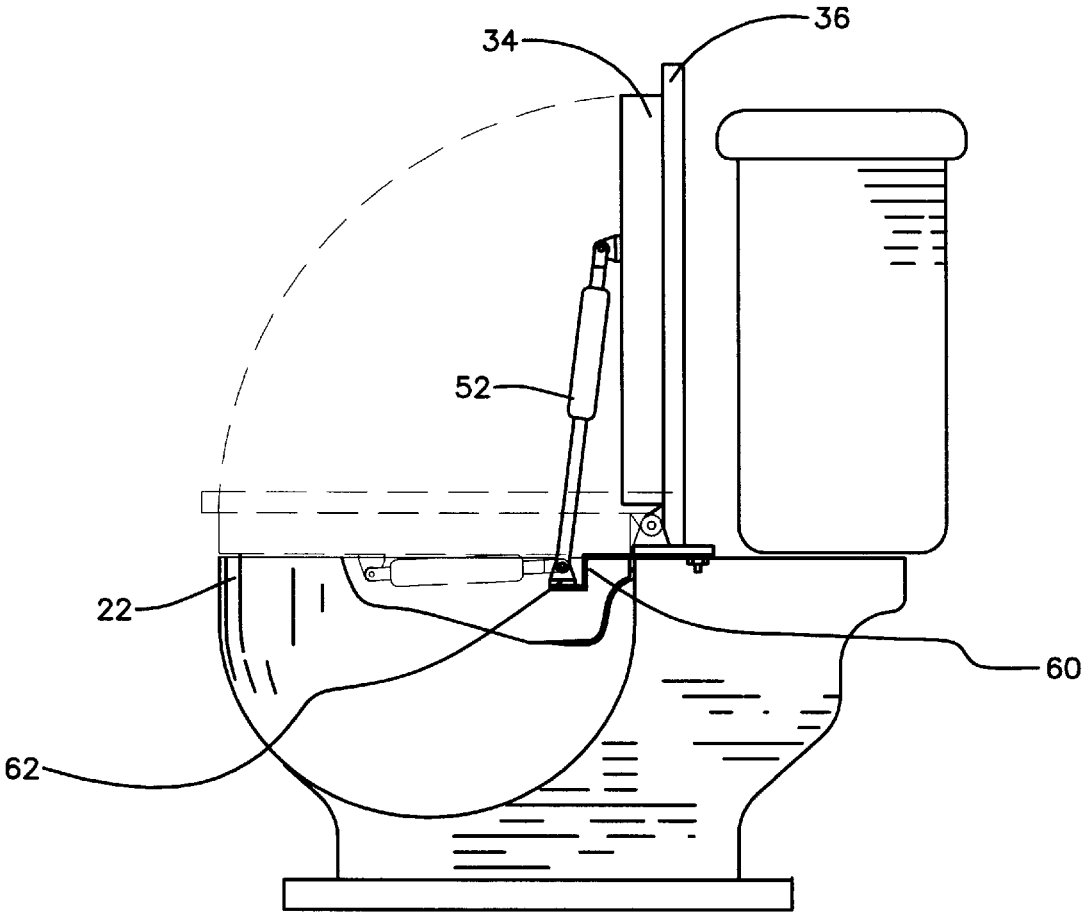
FIG. 2 is a schematic side view of the present invention.
Figure 3:
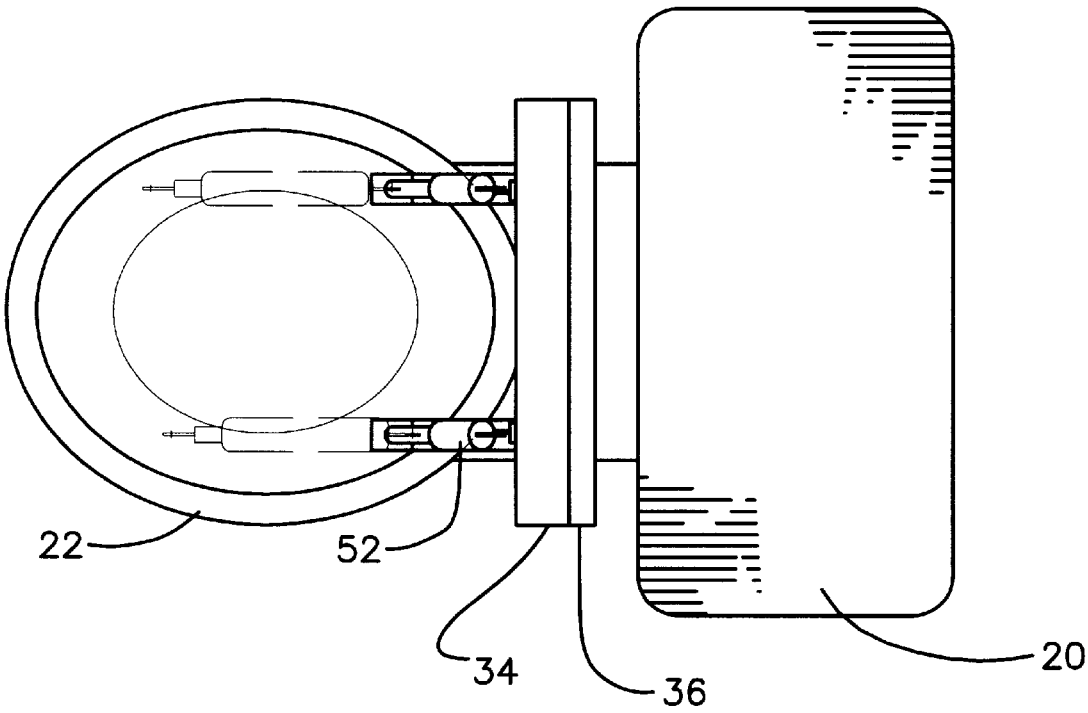
FIG. 3 is a schematic top view of the present invention.
Figure 4:
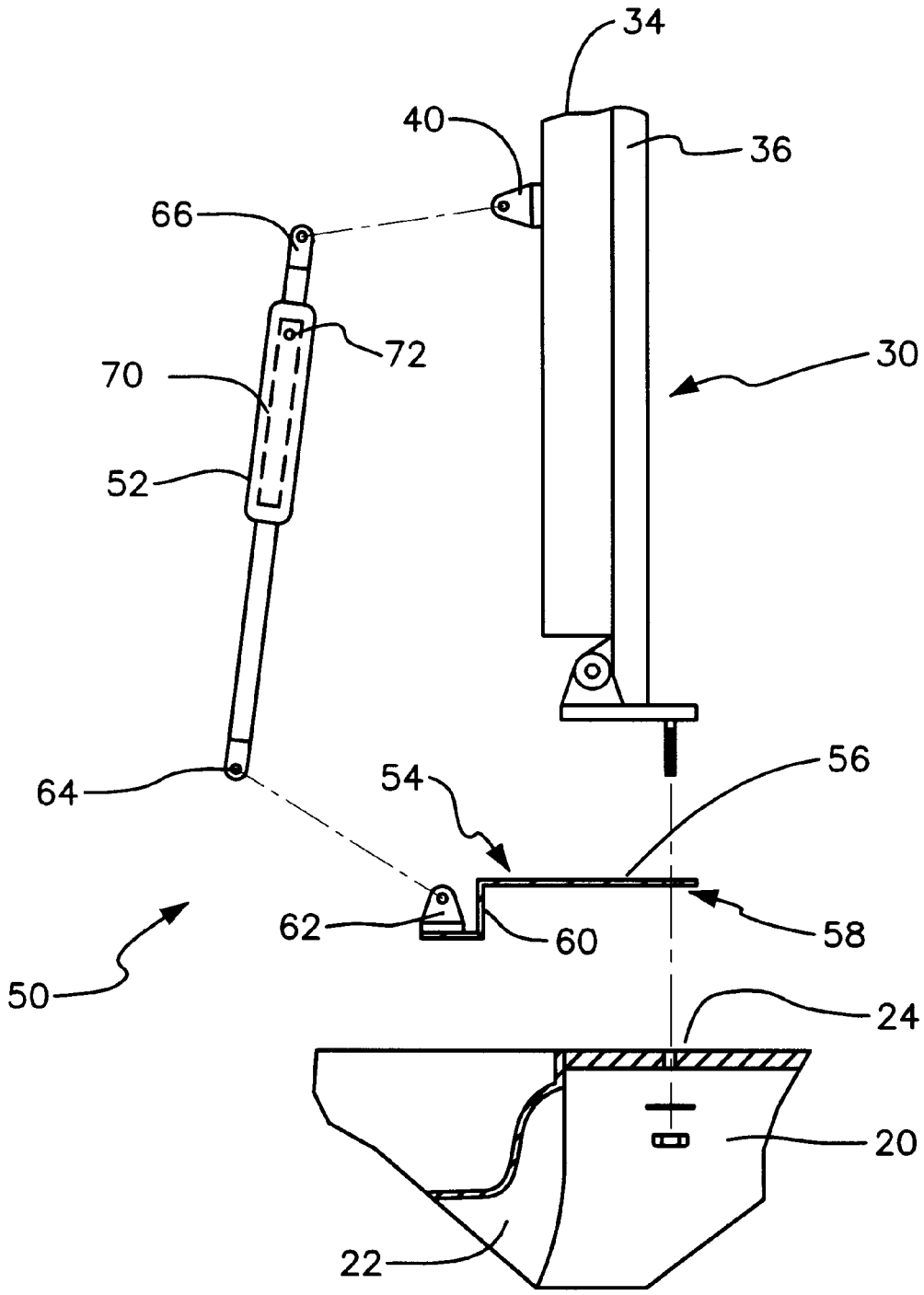
FIG. 4 is a schematic detail view of the seat lowering assembly and seat assembly of the present invention.

With reference now to the drawings, and in particular to FIGS. 1 through 4 thereof, a new toilet seat closing system embodying the principles and concepts of the present invention and generally designated by the reference numeral 10 will be described.

As best illustrated in FIGS. 1 through 4, the toilet seat closing system 10 generally comprises a toilet 20, a seat assembly 30, a seat lowering assembly 50, and a pair of connection members 40.

The toilet 20 includes a bowl portion 22.

The seat assembly 30 is pivotally couplable to the bowl portion 22 such that a seat 34 is pivotable between a substantially upright position and a lowered position.

The seat lowering assembly 50 is coupled to the bowl portion 22. The seat lowering assembly 50 includes a pair of pistons 52. Each of the pistons 52 is coupled to an associated side 32 of the seat assembly 30 such that the pair of pistons 52 supports the seat assembly 30 in a substantially upright position. Thus weight of the seat assembly 30 retracts the pistons 52 over a finite period of time. A longitudinal axis of the seat 34 does not reach a perpendicular relationship with a top surface of the bowl portion 22 in the upright position. Thus the seat assembly 30 in the upright position leans slightly forward of perpendicular and the center of gravity of the seat 34 is always forward of a perpendicular referenced to the top surface of the bowl 22.

The seat lowering assembly 50 includes a mounting bracket 54 with a planar proximal portion 56. The proximal portion 56 includes a pair of holes 58. The holes 58 are alignable with a pair of seat connection apertures 24 in the bowl portion 22 of the toilet 20 such that the mounting bracket 54 is couplable to the bowl portion 22 by clamping the proximal portion 56 between the seat assembly 30 and the bowl portion 22.

The mounting bracket 54 includes a pair of generally L-shaped support portions 60. Each of the support portions 60 includes an offset flange 62 extending orthogonally from a distal edge of the proximal portion 56 such that a distal flange 61 of the support portions 60 is positioned within an interior space defined by an opening in the bowl portion 22 of the toilet 20.

Each of the pistons 52 includes a lower end 64, which is pivotally coupled to an associated one of the distal flanges 61 of the support portions 60.

The seat assembly 30 includes an annular seat member 34 and a substantially planar cover member 36. The cover member 36 is positioned for covering a center of the annular seat member 34 when the cover member 36 is pivoted into an adjacent position relative to the annular seat member 34.

The pair of connection members 40 is coupled to the underside of the annular seat member 34.

Each of the pistons 52 includes an upper end 66 pivotally coupled to an associated one of the connection members 40 extending from the underside of the annular seat member 34 such that the annular seat member 34 is positionable over a rim portion of the bowl portion 22 of the toilet 20 when the seat lowering assembly 50 is in the lowered position.

Each piston 52 includes an interior air chamber 70. Each of the air chambers includes an outlet valve 72 for permitting free flow of air into the air chamber and for dispelling air from the air chamber when the piston 52 is urged into the retracted position.

Each piston 52 includes an interior air chamber. Each of the air chambers includes an outlet valve for permitting free flow of air into the air chamber and for dispelling air from the air chamber when the piston 52 is urged into the retracted position. Each of the outlet valves restricts passage of air through the outlet valve. Thus the seat lowering assembly 50 is designed for closing over a period of time for permitting unobstructed access to the bowl portion 22 of the toilet 20 sufficient to permit a male user to urinate in the toilet 20 as the seat assembly 30 is lowered.

In use, a male user pivots the seat assembly to the upright position. The male user then engages in the conventional use of the bowl portion of the toilet. The seat lowering assembly automatically lowers the seat assembly over a predefined period of time. The predefined period of time being sufficient for the male user to fully utilize the bowl portion of the toilet in the conventional manner, before the seat assembly is lowered into a position such that the seat assembly would begin to obstruct the male users access to the bowl portion of the toilet. After the seat lowering assembly has lowered the seat assembly into the lowered position the bowl portion of the toilet is ready to be accessed by a female user in the conventional manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toilet seat closing system comprising:

a toilet having a bowl portion;

a seat assembly pivotally couplable to said bowl portion such that said seat is pivotable between a substantially upright position and a lowered position;

a seat lowering assembly coupled to said bowl portion, said seat lowering assembly having a pair of pistons, each of said pistons being coupled to an associated side of said seat assembly such that said pair of pistons support said seat assembly in said upright position whereby weight of said seat assembly retracts said pistons over a finite period of time;

said seat lowering assembly including a mounting bracket having a planar proximal portion, said proximal portion including a pair of holes, said holes being alignable with a pair of seat connection apertures in said bowl portion of said toilet such that said mounting bracket is couplable to said bowl portion by clamping said proximal portion between said seat assembly and said bowl portion;

said mounting bracket including a pair of generally L-shaped support portions, each of said support portions having an offset flange extending orthogonally from a distal edge of said proximal portion such that a distal flange of said support portions is positioned within an interior space defined by an opening in said bowl portion of said toilet; and each of said pistons having a lower end pivotally coupled to an associated one of said distal flanges of said support portions.

2. The toilet seat closing system of claim 1, further comprising:

said seat assembly including an annular seat member and a substantially planar cover member, said cover member being positioned for covering a center of said annular seat member when said cover member is pivoted into an adjacent position relative to said annular seat member.

3. The toilet seat lowering system of claim 2, further comprising:

a pair of connection members coupled to said underside of said annular seat member; and each of said pistons having an upper end pivotally coupled to an associated one of said connection members extending from said underside of said annular seat member such that said annular seat member is positionable over a rim portion of said bowl portion of said toilet when said seat lowering assembly is in said lowered position.

4. The toilet seat lowering system of claim 3, further comprising:

each connection member being coupled to a portion of said underside of said annular seat member overhanging said rim of said bowl portion such that said piston is positioned within an interior space defined by an opening in said bowl portion when said seat assembly is in said closed position.

5. The toilet seat lowering system of claim 1, further comprising:

each piston having an interior air chamber, each said air chamber having an outlet valve for permitting free flow of air into said air chamber and for dispelling air from said air chamber when said piston is urged into said retracted position;

each said outlet valve restricting passage of air through said outlet valve whereby said seat lowering assembly is adapted for closing over a period of time for permitting unobstructed access to said bowl portion of said toilet sufficient to permit a male user to urinate in said toilet as said seat assembly is lowered.

6. A toilet seat closing system comprising:

a toilet having a bowl portion;

a seat assembly pivotally couplable to said bowl portion such that a seat is pivotable between a substantially upright position and a lowered position;

a seat lowering assembly coupled to said bowl portion, said seat lowering assembly having a pair of pistons, each of said pistons being coupled to an associated side of said seat assembly such that said pair of pistons support said seat assembly in said upright position whereby weight of said seat assembly retracts said pistons over a finite period of time;

said seat lowering assembly including a mounting bracket having a planar proximal portion, said proximal portion including a pair of holes, said holes being alignable with a pair of seat connection apertures in said bowl portion of said toilet such that said mounting bracket is couplable to said bowl portion by clamping said proximal portion between said seat assembly and said bowl portion;

said mounting bracket including a pair of generally L-shaped support portions, each of said support portions having an offset flange extending orthogonally from a distal edge of said proximal portion such that a distal flange of said support portions is positioned within an interior space defined by an opening in said bowl portion of said toilet;

each of said pistons having a lower end pivotally coupled to an associated one of said distal flanges of said support portions;

said seat assembly including an annular seat member and a substantially planar cover member, said cover member being positioned for covering a center of said annular seat member when said cover member is pivoted into an adjacent position relative to said annular seat member;

a pair of connection members coupled to said underside of said annular seat member;

each of said pistons having an upper end pivotally coupled to an associated one of said connection members extending from said underside of said annular seat member such that said annular seat member is positionable over a rim portion of said bowl portion of said toilet when said seat lowering assembly is in said lowered position; and each connection member being coupled to a portion of said underside of said annular seat member overhanging said rim of said bowl portion such that said piston is positioned within an interior space defined by an opening in said bowl portion when said seat assembly is in said closed position.

7. A toilet seat closing system comprising:

a toilet having a bowl portion;

a seat assembly pivotally couplable to said bowl portion such that a seat is pivotable between a substantially upright position and a lowered position;

a seat lowering assembly coupled to said bowl portion, said seat lowering assembly having a pair of pistons, each of said pistons being coupled to an associated side of said seat assembly such that said pair of pistons support said seat assembly in said upright position whereby weight of said seat assembly retracts said pistons over a finite period of time;

said seat lowering assembly including a mounting bracket having a planar proximal portion, said proximal portion including a pair of holes, said holes being alignable with a pair of seat connection apertures in said bowl portion of said toilet such that said mounting bracket is couplable to said bowl portion by clamping said proximal portion between said seat assembly and said bowl portion;

said mounting bracket including a pair of generally L-shaped support portions, each of said support portions having an offset flange extending orthogonally from a distal edge of said proximal portion such that a distal flange of said support portions is positioned within an interior space defined by an opening in said bowl portion of said toilet;

each of said pistons having a lower end pivotally coupled to an associated one of said distal flanges of said support portions;

said seat assembly including an annular seat member and a substantially planar cover member, said cover member being positioned for covering a center of said annular seat member when said cover member is pivoted into an adjacent position relative to said annular seat member;

a pair of connection members coupled to said underside of said annular seat member;

each of said pistons having an upper end pivotally coupled to an associated one of said connection members extending from said underside of said annular seat member such that said annular seat member is positionable over a rim portion of said bowl portion of said toilet when said seat lowering assembly is in said lowered position;

each connection member being coupled to a portion of said underside of said annular seat member overhanging said rim of said bowl portion such that said piston is positioned within an interior space defined by an opening in said bowl portion when said seat assembly is in said closed position;

each piston having an interior air chamber, each said air chamber having an outlet valve for permitting free flow of air into said air chamber and for dispelling air from said air chamber when said piston is urged into said retracted position; and each said outlet valve restricting passage of air through said outlet valve whereby said seat lowering assembly is adapted for closing over a period of time for permitting unobstructed access to said bowl portion of said toilet sufficient to permit a male user to urinate in said toilet as said seat assembly is lowered.

* * * * *